United States Patent [19]

Beaulieu et al.

[11] Patent Number: 4,926,294

[45] Date of Patent: May 15, 1990

[54] PORTABLE EXHIBIT DISPLAY HEADER

[75] Inventors: Bryan J. Beaulieu, Burnsville; Gary R. Sorenson, Apple Valley, both of Minn.

[73] Assignee: Skyline Displays, Inc., Burnsville, Minn.

[21] Appl. No.: 419,498

[22] Filed: Oct. 10, 1985

[51] Int. Cl.[5] ..... A47F 11/10

[52] U.S. Cl. ..... 362/125; 40/605; 40/610; 40/559; 248/240.4

[58] Field of Search ..... 362/125, 133, 154; 248/240.4; 40/610, 605, 559, 560

[56] References Cited

U.S. PATENT DOCUMENTS

| | | | |
|---|---|---|---|
| 1,408,079 | 2/1922 | Davis et al. | 40/603 |
| 1,515,242 | 11/1924 | Dexter | 248/240.4 |
| 1,580,289 | 4/1926 | Cummings | 248/240.4 |
| 1,759,878 | 5/1930 | Zizzo | 248/240.4 |
| 2,000,537 | 5/1935 | Ransom | 362/125 |
| 2,861,765 | 11/1958 | Kolb | 248/240.4 |
| 3,180,446 | 4/1965 | Wenger | 160/351 |
| 3,817,396 | 6/1974 | Markson | 211/178 R |
| 4,030,219 | 6/1977 | Donovan | 211/195 |
| 4,116,413 | 9/1978 | Andersen | 248/451 |
| 4,444,240 | 4/1984 | Bannister | 160/135 |
| 4,727,994 | 3/1988 | Beaulieu | 211/198 |

*Primary Examiner*—James C. Yeung
*Attorney, Agent, or Firm*—Paul L. Sjoquist

[57] ABSTRACT

A box-like display header that is foldable to a flat orientation for transportation and storage. The header is mountable to an upper portion of a display frame and may include a fluorescent lamp to illuminate the display frame or provide a back lighting for various graphic symbols which may be imprinted on the display header.

13 Claims, 3 Drawing Sheets

PORTABLE EXHIBIT DISPLAY HEADER

The present invention relates to collapsible frames for portable display panels, walls, podiums, tables and the like, and more particularly to headers that are collapsible with such frames.

BACKGROUND OF THE INVENTION

The Beaulieu U.S. Pat. No. 4,727,994 discloses a reflexively collapsible support and attachment structure for use in portable frames for display panels, walls, podiums and tables. The patent further discloses light fixtures mountable on the upper end of such a structure.

SUMMARY OF THE INVENTION

A feature of the present invention is the provision on a display frame, of a box-like display header mountable on an upper portion of the display frame and being collapsible to a flat orientation.

Another feature of the present invention is the provision in a display frame, of a box-like display header with opposing sets of braces pivotally joined to upper braces of the display frame wherein each set of opposing braces includes three braces pivotally joined and being further pivotally joined with the upper brace to form quadrilateral ends of the box-like display header.

Another feature of the present invention is the provision in such a box-like display header, of U-channeled braces of different widths to allow some of the braces nested into other braces to allow the box-like display header to be collapsed to a flat form.

An advantage of the present invention is that a light box may be collapsed into a completely flat package for transportation and storage, yet be opened into an aesthetically pleasing light box assembly disposed across the top of a display frame.

DETAILED DESCRIPTION OF THE PREFERRED EMBODIMENTS

Figure 1:
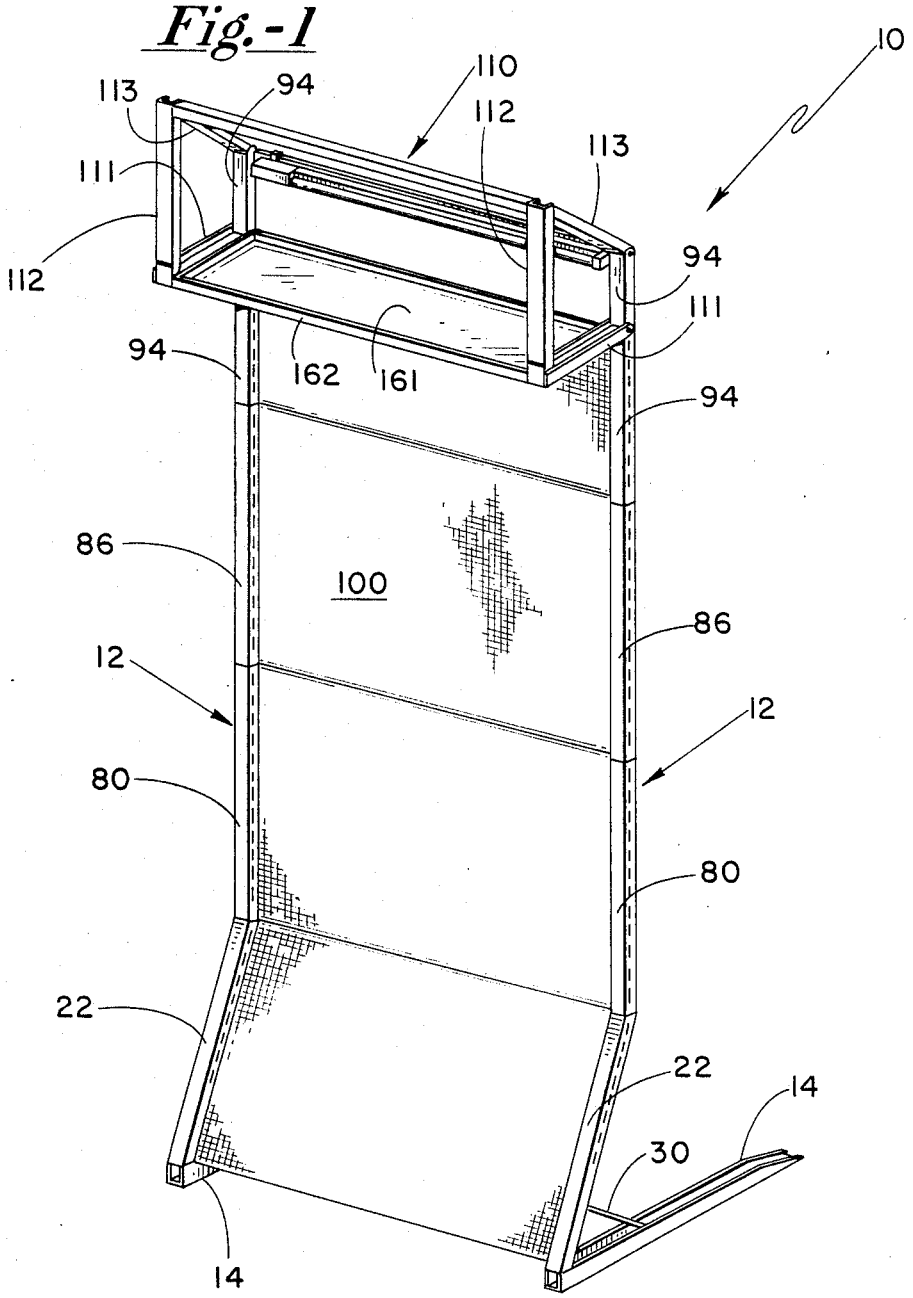
FIG. 1 is a perspective view of the portable exhibit display header mounted on an upper portion of a display frame.

As shown in FIG. 1, a display header or light box assembly is indicated in general by the reference numeral 110. The header 110 is mountable on the fourth, upper brace 94 of the display panel frame 10 of the Beaulieu U.S. Pat. No. 4,727,994, which is hereby incorporated by reference.

As described in the Beaulieu U.S. Pat. No. 4,727,994 and shown in FIG. 1 of the present application, the display panel frame 10 includes parallel interconnected support attachment structures 12. Each of the structures 12 includes a foot 14. Each of the feet 14 is pivotally connected to a first brace 22. A slidably collapsible support strut 30 is mounted between a respective foot 14 and its first brace 22. The display panel frame 10 further includes respective second and third braces 80, 86. The foot 14 and braces 22, 80, 86, 94 and the display header 110 are reflexively collapsible.

Figure 2:
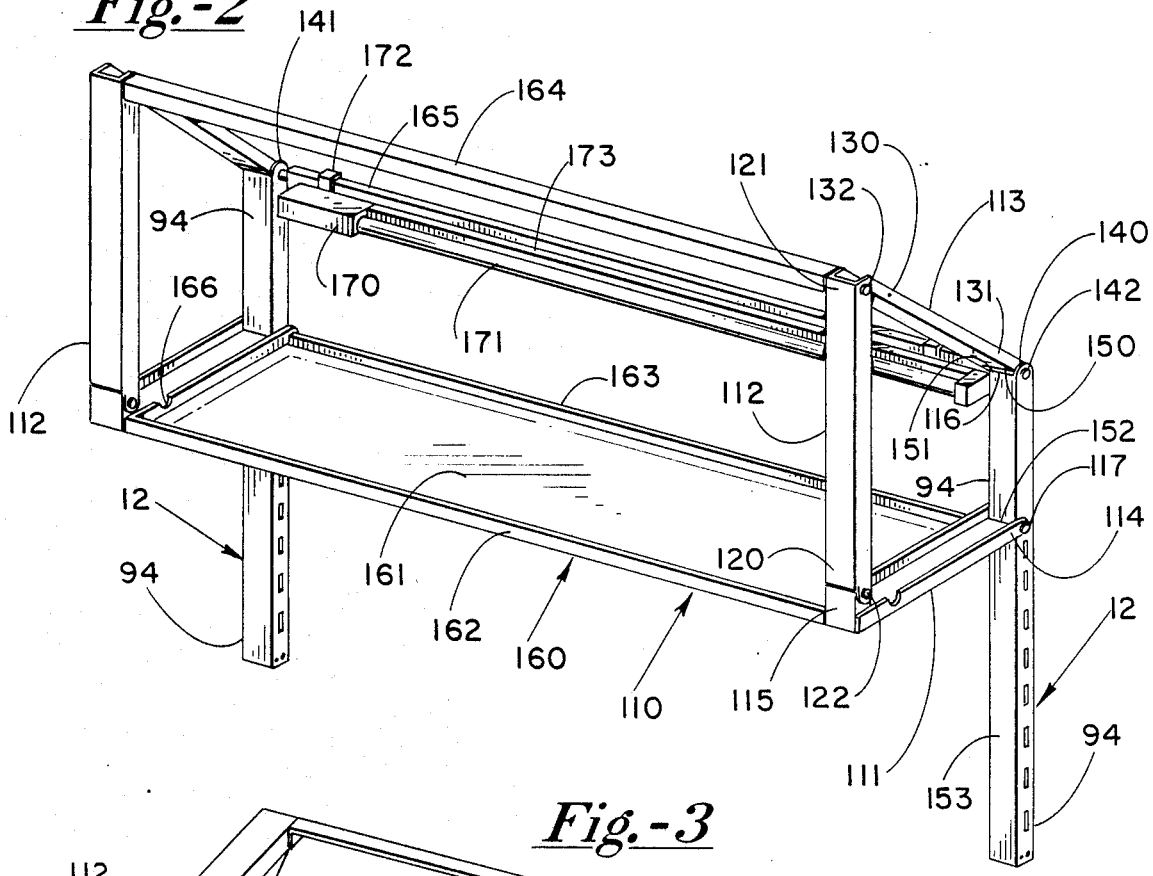
FIG. 2 is a detail perspective view of the display header.

As shown in FIG. 2, the display header 110 includes a set of three U-channeled header braces 111, 112, 113 mounted on each of the support structures 12. Brace 111 includes a pair of ends 114, 115. End 114 is pivotally connected to brace 94 via transverse rivet-like pivot pins 117. End 114 is mounted over brace 94 so that brace 94 is receivable in the interior of brace 111. Brace 111 further includes the latch release button 90 described in the Beaulieu U.S. Pat. No. 4,727,994.

Header brace 112 includes a pair of ends 120, 121 with end 120 being pivotally connected via transverse rivet-like pivot pins 122 to end 115 of brace 111. End 115 extends slightly from brace 111 at a right angle so that end 120 is spaced from the main section of brace 111. Pivot pins 122 ride in transversely aligned slots 123 formed in end 120 (see FIG. 5). The slots 123 are formed parallel with the length of brace 112. Brace 112 is therefore somewhat slidable relative to end 115 of brace 111, by pivot pin 122 sliding in the slot 123.

Header brace 113 includes a pair of ends 130, 131 with end 130 being pivotally connected via transverse rivet-like pivot pins 132 to end 121 of header brace 112. End 130 is nested within end 121 so that U-channeled brace 113 is receivable in the interior of brace 112.

The upper end 116 of brace 94 includes a pair of outer and inner side extensions 140, 141 with transversely aligned apertures for receiving a pivot pin 142. End 131 of brace 113 is pivotally connected between side extensions 140, 141 via pivot pin 142 so that brace 113 is receivable in the interior of U-channeled brace 94.

End 131 of brace 113 includes an integral curled lip 150 which is bearable against an upper edge 151 of brace 94. End 114 of brace 111 includes an edge 152 which is bearable against a face 153 of brace 94.

A four-sided frame 160 for a translucent lighting panel 161 is rigidly affixed to and between header braces 111. The four-sided frame 160 includes transverse supports 162, 163. A transverse support 164 is affixed to and between ends 121 of header braces 112. A transverse support bar 165 is pivotally affixed via the pivot pins 142 between ends 116 of braces 94. Accordingly, support 165 is pivotable. The header brace 111 includes U-shaped slots 166 for receiving portions of transverse support bar 165 and pins 142.

A fluorescent lamp 170 with a glass tube 171 is mountable on the pivotable support 165 via a pair of mounting brackets 172.

On display, the header 110 is disposed as shown in FIGS. 1 and 2. Edges 152 of braces 111 bear against faces 153 of braces 94 and curled lips 150 of braces 113 bear against upper edge 151 of brace 94. A cloth-like header panel is typically attached via magnetized strips between braces 112. Other cloth-like header panels may be attached on both sides of the header 110 between braces 112 and their respective braces 94.

Furthermore, on display, it should be noted that a number of display panel frames 10 with headers 110 may be interconnected. As shown in FIG. 14 of the Beaulieu U.S. Pat. No. 4,727,994, any number of frames 10 may be interconnected and quickly assembled so as to create a continuous display of a desired width. For instance, two to twenty or more frames may be interconnected to form an illuminated continuous display. The illumination is provided by the fluorescent lamp 170 disposed in each light box assembly or display header 110. The lamp 170 casts light on each of the fabric panels 100 of the two to twenty or more of the display frames 10 through the respective translucent panels 161. It should also be noted that a translucent panel may be connected between braces 112 so that the lamp 170 provides a rear or back lighting for various graphic symbols which may be imprinted on the translucent panel connected between braces 112.

Figure 3:
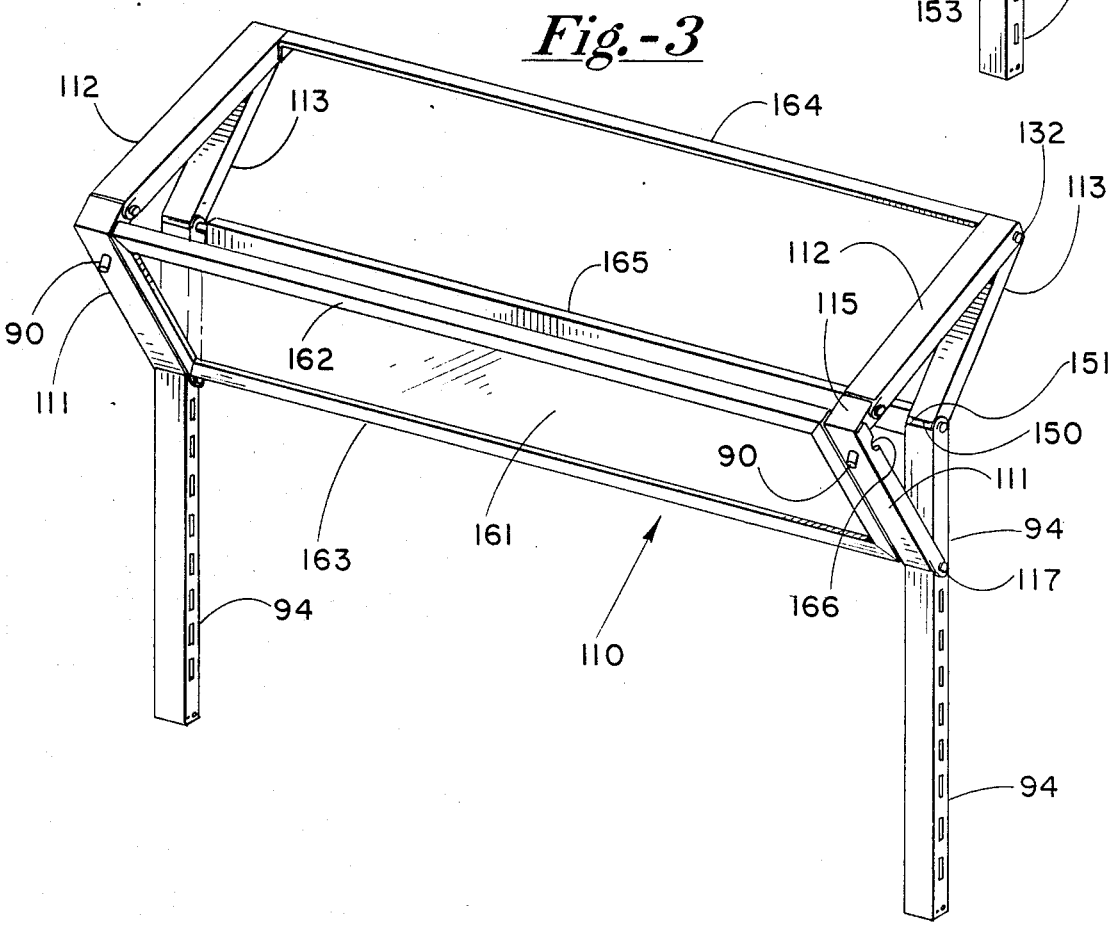
FIG. 3 is a detail perspective view of the display header being collapsed from a deployed orientation to a flat orientation.
Figure 4:
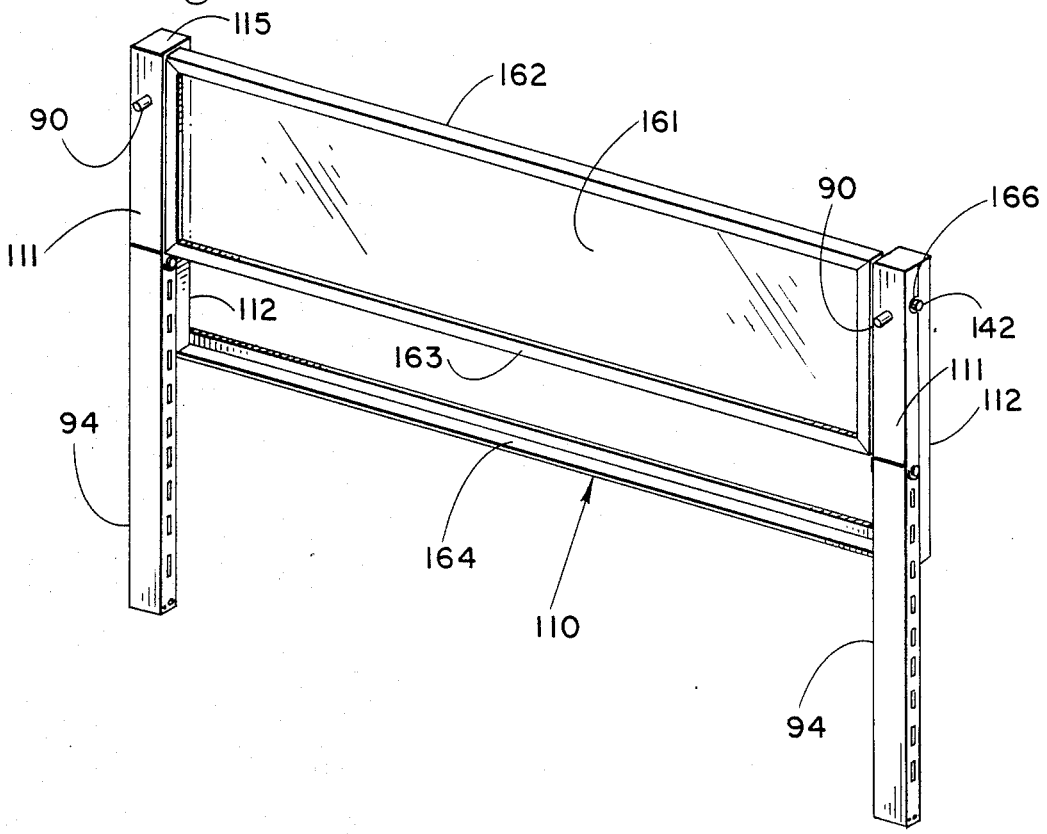
FIG. 4 is a detail perspective view of the display header in a flat orientation.
Figure 5:
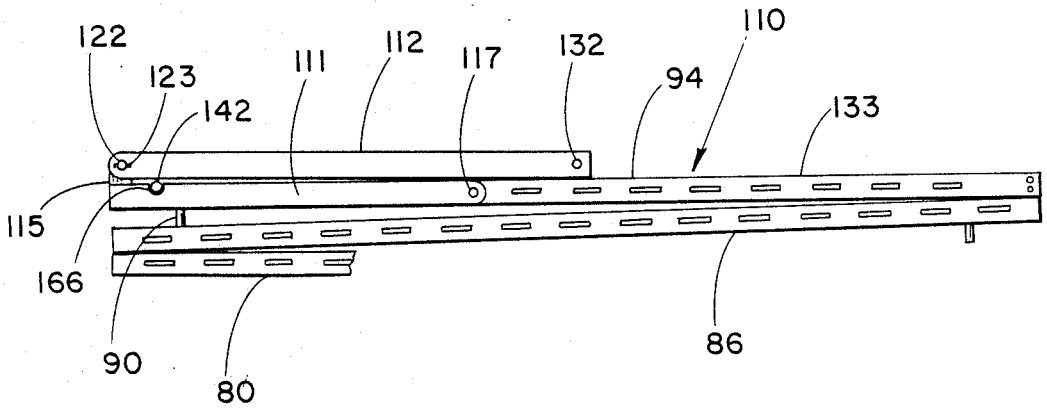
FIG. 5 is a partial elevation view of the display header and display frame collapsed into a flat package.

To fold the display header 110 from the box-like deployed orientation as shown in FIGS. 1 and 2 to the flat orientation shown in FIGS. 4 and 5, magnetized header panels are first removed from the display header 110. The fluorescent lamp 170 is then removed from the support bar 165. Subsequently, as shown in FIG. 3, braces 111 and 113 are pivoted upwardly about pins 117 and 142 so as to swing braces 112 from a frontwardly disposed position relative brace 94 to a rearwardly disposed position relative to brace 94. Braces 113 are swung downwardly into the U-channeled rear sides of brace 94 so as to swing braces 111 onto the front side of braces 94 and so as to swing braces 112 onto braces 113. Pins 122 slide in slots 123 to accommodate this movement. Braces 94, 111, 112, 113 are brought into a generally parallel relationship until the slots 166 receive portions of the support bar 165 and pins 142 and until the outwardly extending sides of end 130 of brace 113 bear against edge portion 133 of brace 94, as shown in FIG. 4. After being disposed into flat orientation, the display 10 may be reflexively collapsed as shown in FIG. 5 and as described in the Beaulieu U.S. Pat. No. 4,727,994.

To deploy the display header 110 from the flat orientation shown in FIGS. 4 and 5, the folding procedure is simply reversed. Braces 111 are swung downwardly and braces 113 are sequentially swung upwardly, forwardly and downwardly until edges 152 of braces 111 and curled lips 150 of braces 113 bear against braces 94.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A box-like display header for a display frame having a pair of vertically extendable, spaced-apart mounting braces, the display header comprising:

a first and second set of braces respectively connected to the pair of mounting braces of the display frame, each set of braces including an upper brace, a lower brace, and a front brace, means connected between the mounting braces for laterally connecting the mounting braces to each other, means connected between the first and second sets of braces for laterally connecting the sets of braces to each other, each upper brace being pivotally connected to a top portion of a mounting brace and being swingable to the front and rear sides of the mounting brace, each lower brace being pivotally connected to a lower portion of a mounting brace and being swingable against said mounting brace, and each front brace being pivotally connected to an upper and lower braces and being swingable about the mounting braces, whereby the display header may be collapsed to a substantially flat form against said mounting braces.

2. The display header of claim 1, wherein the braces are U-channeled.

3. The display header of claim 2, wherein each of the upper braces has a width less than the width of each of the front braces, so that the upper braces are receivable lengthwise into the front braces.

4. The display header of claim 2, wherein each of the mounting braces has a width less than the width of each of the lower braces so that the mounting braces are receivable lengthwise into the lower braces.

5. The display header of claim 1, further comprising a light suspended between said mounting braces and within the space defined by said first and second set of braces.

6. The display header of claim 5, wherein a translucent panel is connected between the lower braces.

7. A foldable box-like display header for a display frame having a pair of first and second rear braces, the display header comprising:

a first set of three braces being pivotally joined and being further pivotally joined with the first rear brace of the display frame to form a first quadrilateral orientation, the first set of braces being swingable from the first quadrilateral orientation to lie generally parallel to each other in a generally flat orientation with at least one of the first set of braces being receivable in another of the first set of braces, and a second set of three braces being pivotally joined and being further pivotally joined with the second rear brace of the display frame to form a first quadrilateral orientation, the second set of braces being swingable from the first quadrilateral orientation to lie generally parallel to each other in a generally flat orientation with at least one of the second set of braces being receivable in another of the second set of braces, whereby ornamental panels may be connected to and between certain of the braces to form a box-like display header for the display frame.

8. The display frame of claim 7, wherein one of the braces from each of the first and second sets is swingable between front and rear sides of the rear braces of the display frame so that the header extends from the display frame and is collapsible to a flat orientation in which two of the braces from each of the sets lie on the rear sides of the rear braces.

9. The display frame of claim 7, further comprising a transverse support bar connected between the first and second sets of braces so that the braces of each set may be swung in unison between the quadrilateral and flat orientations.

10. The display frame of claim 9, further comprising three additional transverse support bars, each of the transverse bars being connected between corners of the quadrilaterals.

11. The display frame of claim 7, wherein the braces are U-channeled with different widths so that some of the braces are receivable lengthwise in other braces.

12. The display header of claim 7, wherein a translucent panel is connected between one of the first set of braces and one of the second set of braces.

13. The display header of claim 7, wherein a light is disposed in the box-like display header.

* * * * *